United States Patent [19]

Oltmanns et al.

[11] 4,299,070

[45] Nov. 10, 1981

[54] BOX FORMED BUILDING PANEL OF EXTRUDED PLASTIC

[75] Inventors: Heinrich Oltmanns, 2905 Edewecht, Jeddoloh I, Fed. Rep. of Germany; Axel Granz, Oldenburg, Fed. Rep. of Germany

[73] Assignee: Heinrich Oltmanns, Jeddeloh, Fed. Rep. of Germany

[21] Appl. No.: 50,653

[22] Filed: Jun. 21, 1979

[30] Foreign Application Priority Data

Jun. 30, 1978 [DE] Fed. Rep. of Germany ..... 2828769

[51] Int. Cl.[3] ..... E04C 1/10; E04C 1/30

[52] U.S. Cl. ..... 52/309.11; 52/309.1; 52/403; 52/594; 52/606

[58] Field of Search ..... 52/309.1, 309.11, 403, 52/568, 591, 594, 595, 522, 593, 606

[56] References Cited

U.S. PATENT DOCUMENTS

| | | | |
|---|---|---|---|
| 2,192,723 | 3/1940 | Whitacre | 52/606 |
| 3,100,917 | 8/1963 | Wagner | 52/309.1 |
| 3,403,491 | 10/1968 | Eichman | 52/403 X |
| 3,526,071 | 9/1970 | Watanabe | 52/403 |
| 3,755,978 | 9/1973 | Jackson | 52/595 |
| 3,813,838 | 6/1974 | Brown et al. | 52/403 X |
| 4,062,161 | 12/1977 | Schubach | 52/403 X |
| 4,155,206 | 5/1979 | Player | 52/522 X |

FOREIGN PATENT DOCUMENTS

| | | | |
|---|---|---|---|
| 920764 | 2/1973 | Canada | 52/593 |
| 2226460 | 12/1973 | Fed. Rep. of Germany | 52/606 |
| 2259006 | 6/1974 | Fed. Rep. of Germany | 52/309.1 |
| 1357476 | 2/1964 | France | 52/309.1 |
| 1484291 | 5/1967 | France | 52/595 |
| 703901 | 4/1966 | Italy | 52/594 |
| 442681 | 1/1968 | Switzerland | 52/593 |
| 593448 | 11/1977 | Switzerland | 52/594 |
| 614394 | 12/1948 | United Kingdom | 52/593 |
| 901935 | 7/1962 | United Kingdom | 52/309.1 |
| 1066701 | 4/1967 | United Kingdom | 52/593 |
| 1201427 | 8/1970 | United Kingdom | 52/593 |

*Primary Examiner*—Alfred C. Perham
*Attorney, Agent, or Firm*—Andrus, Sceales, Starke & Sawall

[57] ABSTRACT

A box formed building panel has a section in the end walls that joins the panel to an adjacent panel and seals the joint against heat loss. The joining and sealing functions may be combined in a single construction, such as a wedge-shaped projection on one panel insertable into a sealant containing groove in the other panel, or, separate projection and groove combinations may be used for joinder and for sealing. Internal walls and stiffeners may be mounted in the building panel. The building panel may be filled with foam and auxiliary panels mounted on the building panel.

18 Claims, 13 Drawing Figures

BOX FORMED BUILDING PANEL OF EXTRUDED PLASTIC

The invention relates to a box formed building panel of extruded plastic with a series of hollow spaced arranged between oppositely lying sidewalls and end walls and separated from each other through partitions and a fastening section on the end walls which is lockingly brought into engagement with an adjacent section.

It is known that in buildings, the windows are a critical factor with respect to thermal insulation. For the improvement of thermal insulation with windows it is known to utilize so-called double or multiple glazing, by which glass plates are arranged at a small spacing from each other and form a "vacuum chamber" between themselves sealed from the outside. Such glazings are, however expensive, particularly with larger plates. Additionally, there is the danger that they can be destroyed through impact. That is particularly true in connection with all buildings for industrial plants or sports facilities.

It is thus already known to employ panels of extruded light transmitting plastic as lighting surfaces for halls, industrial buildings, and business buildings. In this connection it is known to form the end walls of the panel with a groove or a thereto complementary tenon, in order to insure a secure coaction of adjacent panels. A locking mechanism therefor is not provided (DT-GM 1,989,172).

It is further known to provide in the end walls of such panels, angularly formed projections meshing into one another, which are furnished with barbed type projections (DT-GM 7,714,614). These panels can be mounted at their sides, whereby the barbed projections come into engagement with each other with opposing pressures of the wall elements. During installation, a row of panels is initially mounted with the retention of a spacing amounting to the width of a panel. After that the remaining panels are subsequently pressed in the intermediate spacing. It is thus necessary to observe the exact spacing of the first mounted panels.

Because of the relatively large distance between the sidewalls and the proportionately thin partitions, proportionately favorable thermal insulation properties follow. These favorable properties are however partially removed through a cold bridging formation in the joint areas of the building panels. Because of the proportionately large thermal coefficient of expansion of usable plastic materials, sufficient space must remain between the individual panels so that the building panels do not warp if with predetermined expansion the possibility of cleavage does not exist. Hence, greater or lesser size cracks are located between the adjacent building panels which admit to a greater or lesser amount of heat transmission.

The invention has as its object to provide a box formed building panel of extruded plastic which makes possible an improved thermal insulation.

This object is fulfilled according to the invention in that an end wall has a recessed groove section, in the base of which, a flexible sealing material is placed and in which a projection of the adjacent end wall formed in a complementary manner to the groove section is sealingly bringable into engagement with the resilient gasket material.

In addition to the interlocking of the end walls the groove section forms a labyrinth connection of adjacent building panels, by means of which a considerable lengthening of the cracks between the adjacent building panels is formed with the corresponding favorable effect on the thermal insulation. The additional material arranged in the groove section cuts off corresponding cold flow, so that the thermal insulating and sound insulating properties of such a building panel reach fully to the limit.

The sealing material is resilient so that the sealing section, complementary with the groove section, is pressed against the sealing material with the positioning of the building panel and under the surface pressure meets in engagement with it.

A refinement of the invention provides that the groove base is formed from a partition, against which the resilient sealing material is supported and the projection is lockingly bringable into engagement with the complementary formed groove walls. Such a building panel is normally slightly thicker than 4 to 5 cm, so that there is thus sufficient room for a single groove so provided to perform the different functions. Building panels with a single groove in the end wall and a thereto complementary locking section cause no difficulties with the extrusion concerning the appearance of stresses, the occurrence of unequal wall thickness and particularly danger in use.

With the building panel according to the invention the locking profile engages, along the entire length, with the sealing material which preferably is elastically yielding. Through this the advantage is obtained that the sealing material can, for that purpose, contribute to strengthening the locating or interlocking engagement. The sealing material presses, in the assembled condition, the locking section against the corresponding contact surfaces of the groove wall, in order to lock these parts effectively against each other. The length increase resulting from the temperature rise through a coefficient of thermal expansion, is absorbed through the sealing material without causing undesired deformation on parts of the building panel.

It is particularly advantageous for the extrusion and manufacture of the work pieces, if the section of the groove and locking projection are arranged symmetrically to the longitudinal medial plane of the building panel. Consequently, the sealing material is also arranged symmetrically thereto.

In order to insure favorable installation with simultaneous effective anchoring after the mounting, the grooved walls, in the free end regions, are inwardly jaw-like and coact with correspondingly formed locking grooves of the projection. With the insertion of the projection, the groove side walls are somewhat outwardly but away from each other bent so long as the jaw-shaped projections do not engage in the locking grooves.

The abutment forming a border of the building panel in the direction in which the panels lie against each other is preferably formed of end wall sections on both sides of the groove running approximately parallel to the partitions, against which both sides of the end wall sections running along the locking section lie, when the groove and the projection are interlocked.

An especially advantageous arrangement results when the groove walls initially outwardly diverge away behind the jaw formed section and immediately before the jaw-formed section converge, preferably at approximately a right-angle to the diverging wall sections, while in the jaw-formed section the groove wall sections further diverge, preferably at a similar angle as the other diverging wall sections. The projection is formed in a complementary manner so that the side walls of the projection represent a wedge form, which solely in the region of the converging sections is interrupted. The converging sections of the groove side walls and thereto complementary sections of the projection form shoulder-like abutment faces, which by means of the sealing material are pressed against each other.

The partition forming the base of the groove serves for the support of the resilient sealing material. There can be formed on the partition two preferably parallel ribs spacedly arranged from each other, between which the resilient sealing material is arranged. The resilient sealing material can be a strip of elastic yielding sealing material, for example sponge rubber. It is preferably glued on the partition with its reverse side, whereby the ribs insure a secure position and that the resilient sealing material does not shift too far to the side. It is however, equally well realizable, to make sealing sections out of elastic material, which coact in a form locking manner with the undercuts of the ribs.

A further possibility according to the invention is found in that the elastically deformable resilient sealing material is plactically molded in the intermediate space between the ribs.

In order to obtain the highest possible effective sealing construction between the projection and the sealing material, the frontal surface of the locking projection is outwardly arched in form.

In many cases it is desired to introduce a so-called stiffening section in the building panel, in order to produce an increased static loading in the transverse direction. Thus, the partition forming the groove base can form a bordering surface for a reinforcing section in the side lying opposite the groove. It is without more possible, to form a further partition, spaced to the partition forming the groove base so that a proportionately slender cavity is formed, in which a stiffening section can be introduced. This measure is however, proportionately material consuming. It is therefore preferable if, spaced to the partition on the inner side of the longitudinal walls, inwardly pointing ribs are formed as abutments for the reinforcing section.

It is to be understood that the building panel according to the invention can be installed in any position, that is, in a vertical, horizontal, or oblique position. The side walls can receive an additional section, preferably a corrugation on the inner side for the purpose of producing desired lighting effects. It is also possible through coloration, to achieve desired optical effects. Finally, it is also without more possible to fill up the cavity of the building panel with a suitable plastic foam, by which a considerably increased thermal insulation is achieved.

An improved thermal insulation is also achieved if at least one intermediate wall connecting the partitions with each other and running between the longitudinal walls is formed. Without additional precautions increased complications result, however, with the extrusion of a suitable section. As is known the inner lying material cools later than the further outwardly lying material so that a solidification does not occur simultaneously. Increased distortion can thus result, which impairs the shape of the building panel altogether or at least the shape of the partitions. There is thus provided that the length of the intermediate walls is somewhat greater than the spacing of the partition. Preferably, the intermediate walls can be formed, between two adjacent partitions, from two intermediate wall sections, which are arranged at an obtuse angle to each other. Neither an elongation nor a shortening leads to transverse forces affecting the partitions.

By means of suitable precautions it is possible to combine together in layers a plurality of building panels; that is, to join a complete building panel with an auxiliary panel in order to achieve a greater thickness and therewith a greater thermal insulation. For this, an auxiliary panel element with a one-sided longitudinal wall can be provided, which has, on the sides, sections forming unbent end surfaces and on one side, flange arrangements formed in pairs which on the free sides have undercuts for the purpose of anchoring fastening means. It is without more possible, to fasten auxiliary panel elements by means of ribs or flanges on a box formed building panel and to use glue on the building panel. With the mentioned modification of the invention is it however preferable to employ fastening means, for example in the form of rivets in an already existing building panel, whereby the outwardly projecting rivet heads can lockingly meet in engagement with the undercuts of the flanges. For the insertion of the fastening means can it however also alternatively be provided, that on the inner sides of a longitudinal wall, canals are molded, that are sealed by a film in the side lying in the longitudinal wall plane, whereby the canal likewise has undercuts for mounting of a fastening means. The fastening means can for the insertion be driven through the film and anchored in the canal, while the projecting end, on the other hand, is anchored with an auxiliary panel element.

In a further embodiment it is provided, that the groove is arranged parallel to the intermediate walls and faces, while inwardly displaced, a locking section flange on the same end wall. With this embodiment can initially the location be produced with an easily inclined building element, whereby first through a light inward swivel in the plane of the already mounted building panels the sealing engagement is fully produced.

On grounds of stability, the building elements have only a predetermined thickness, which ordinarily lies between 30 and 40 mm. An improved heat and cold insulation can also for this reason be obtained, if one or more intermediate walls parallel to the side walls are provided. While the heretofore known light transmitting building panels represent a so-called single chamber form, with the invention two or more chamber sections are produced, whereby the overall thickness ordinarily increases and therewith the thermal insulation can be conclusively improved. In this connection it is of advantage if the partitions on both sides of an intermediate wall are arranged staggered to each other in order that the cold bridge, which through partitions is undoubtedly formed, takes as long as possible to occur.

Exemplary embodiments of the invention are further explained with aid of the following drawings.

Before the individual exemplary embodiments are considered in more detail, it is to be noted that each of the construction features to be described and claimed, alone or in combination, is of significance to the invention.

Figure 1:
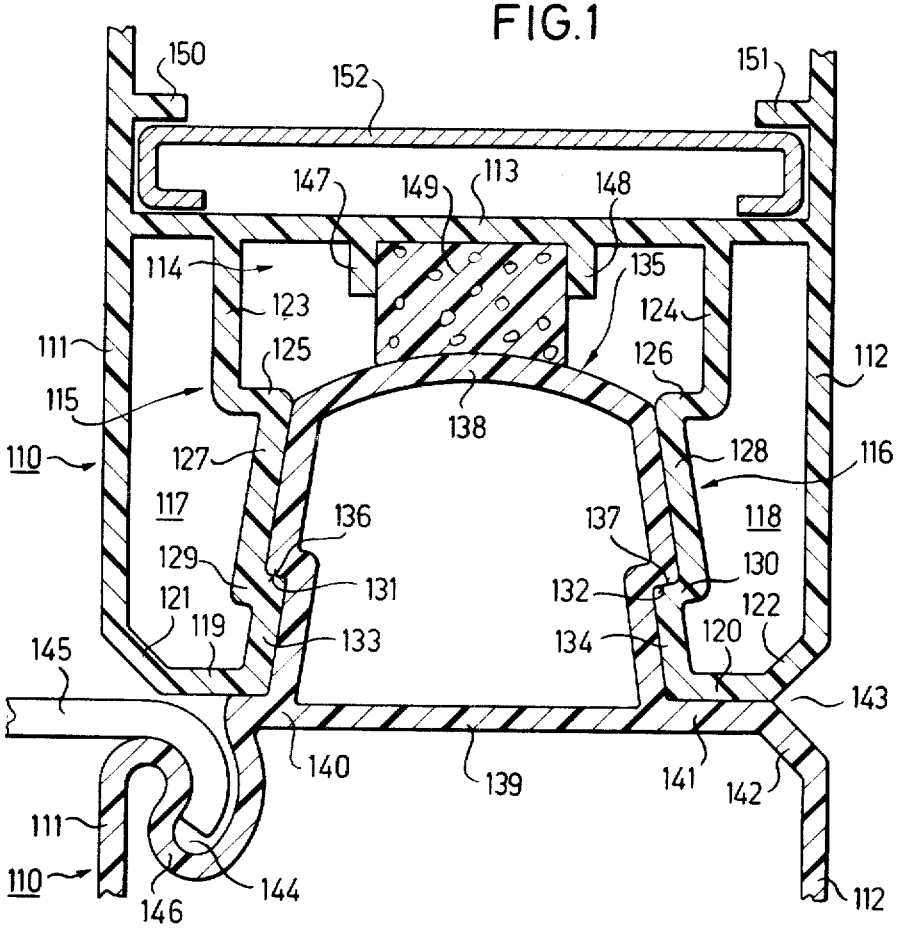
FIG. 1 shows a section through two adjacent building panels according to the invention.

The building panels represented in FIG. 1 are identified generally with 110 and have two spaced parallel side walls 111 and 112, which are connected with each other through transverse walls, one of which is indicated with 113. In a face surface a groove or canal 114 is molded, whose bottom is formed by transverse wall 113 and whose side walls 115 and 116 run spacedly from the walls 111 and 112, so that chambers 117 and 118 are formed therebetween which are closed by the surfaces of wall sections 119 and 120 parallel to the transverse wall 113, and slanting wall sections 121 and 122 which slant upward in the walls 111 and 112.

The groove or canal walls 115, 116 are step formed. They are connected with the transverse wall 113 above sections 123 and 124 which are parallel to the side walls. There is a small wall section 125 and 126 running at right angles thereto. From these extend wall sections 127 and 128 diverging to the groove opening. Short sections 129 and 130 converging to the groove openings connected to wall sections 127 and 128 through which sloping shoulder surfaces 131, 132 are formed. Further diverging wall sections 133, 134 connect on converging wall sections 129, 130. The opening angle of converging wall sections 133, 134 corresponds to that of wall sections 127, 128. The diverging wall sections 133, 134 merge into end wall sections 119, 120.

The other building panel has a projection 135 in the form of a bar extending along the building panel whereby the side walls of the projection 135 are formed complementary to the wall sections 127, 128, 129, 130, 133 and 134 so that an outer sloping shoulder 136 and 137 forms a locking catch with the inner shoulder 131 and 132. The end wall 138 of projection 135 is outwardly curved in an arched form.

The cavity formed in the inside of projection 135 is, in the area of the face of building panel 110, closed through a wall section 139, which lies in the same plane as the face wall sections 140 and 141 parallel to the transverse walls. A sloping wall section 142 connects in the wall section 141 and merges with the associated side wall 112 so that between the pushed together panels 110, a groove 143 triangularly formed in cross section is formed. The portion joining the wall section 140 is turned to an inverted position for the formation of a curved groove 144, which extends in the direction of the side wall 111 to contain a fastening element 145, hook formed on the end. As one appreciates from FIG. 1, the inside out section 146 is spaced at a distance to side wall 111.

On the transverse wall 113 are formed ribs 147, 148 directed in the canal interior which extend parallel to and spaced from each other in the canal interior and on their sides form a canal for receiving a sealing strip 149 of elastically deformable material.

On the inner side of side walls 111 and 112 ribs 150 and 151 are formed which extend parallel to the transverse wall 113 at a spacing with respect thereto. Through the transverse wall 113 and the ribs 150 and 151 is formed a mounting space for the mounting of a box formed stiffening member 152, which for example is formed out of extruded metal or a metal plate. The side of the stiffening profile 152 lying to the transverse wall 113 is essentially open.

To mount the building panel the projection 135 is pushed in the canal 114, whereby the wedge formed head on the side of the projection 135 bends apart the side walls 115, 116 of the groove somewhat, until the shoulder surfaces 131, 136 and 132, 137 lockingly engage with each other. Simultaneously the sealing material strip 149 is somewhat compressed above the arches section 138, so that in this position an effective sealing is accomplished. The spring effect of the sealing material 149 additionally provides for the effective engagement of the shoulder surfaces 131, 136 and 132, 137. The transverse slit formed between the wall sections 119, 120 and 140, 141 should be held as small as possible; however it should not fall below a minimum width, that with the coefficient of thermal expansion would lead to a pushing together of panels 111 and to side deflection.

Figure 2:
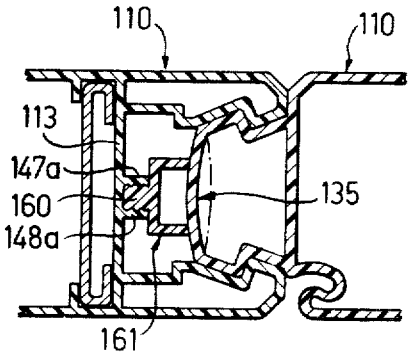
FIG. 2 shows a section similar to FIG. 1 with, however, an altered sealing element.
Figure 3:
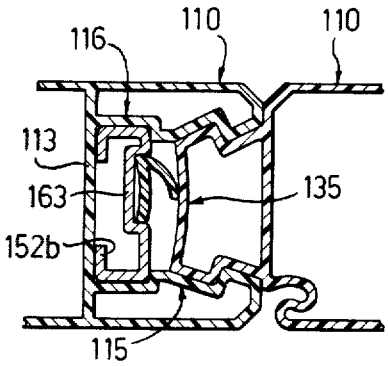
FIG. 3 shows a section similar to FIG. 1 with, however, a third embodiment of a sealing element.

The connections between box formed panels 110 illustrated in FIGS. 2 through 3 are similar to that according to FIG. 1, so that a further description can be omitted. The differences lie merely in the mounting and the formation of the sealing material. With the embodiment according to FIG. 2 the ribs **147*a* and 148*a* on the end wall 113 are toothed on the inner side for the fastening of a flange 160 of a U-formed sealing section 161** of an elastomeric material.

With the embodiment according to FIG. 3 the ribs 150 and 151 according to FIG. 1 are not used and a box formed stiffening section **152*b* is supported between the transverse wall 113 and the initial interruption of the groove side walls 115 and 116. The stiffening profile 125*b* has, on side directed to the groove opening, an indentation 163 for the mounting of a leg of an angle formed sealing strip, whose other flank, slantingly directed to the opening, lies against the front side of the projection 135**.

Figure 4:
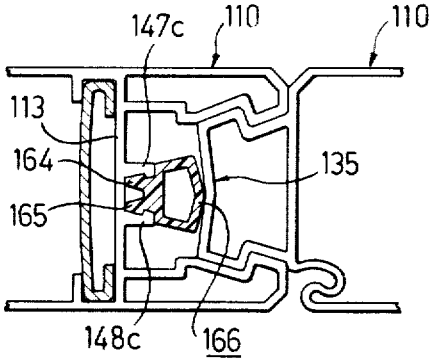
FIG. 4 shows a fourth embodiment of the sealing element.

With the embodiment according to FIG. 4 the ribs **147*c*, 148*c* have undercuts for the mounting of feet 164, 165 of a hollow sealing profile strip 166, which lies against the front face of the ribs 147*c*, 148*c* and is supported with the oppositely arched side against the projection 135. The feet 164 and 165 are formed on the outside complementary to the ribs 147*c* and 148*c*** and outwardly forced apart in order to be maintained permanently in the undercuts.

Figure 5:
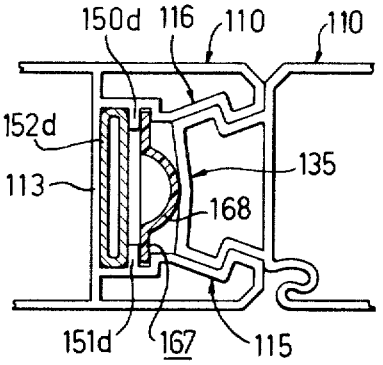
FIG. 5 shows a fifth embodiment of the sealing element.

FIG. 5 shows a closed box profile as stiffening strip **152*d*, on one side of which lies a transverse wall 113 and on the oppositely lying side of which lie ribs 150*d*, 151*d*, which project in the inside of the groove. A groove is formed between the ribs 150*d* and 151*d*, and a first recess the groove side walls 115 and 116, in which a sealing strip 167 is inserted, which has a section 168 arched to the groove opening, against which the projection 135** lies.

Figure 6:
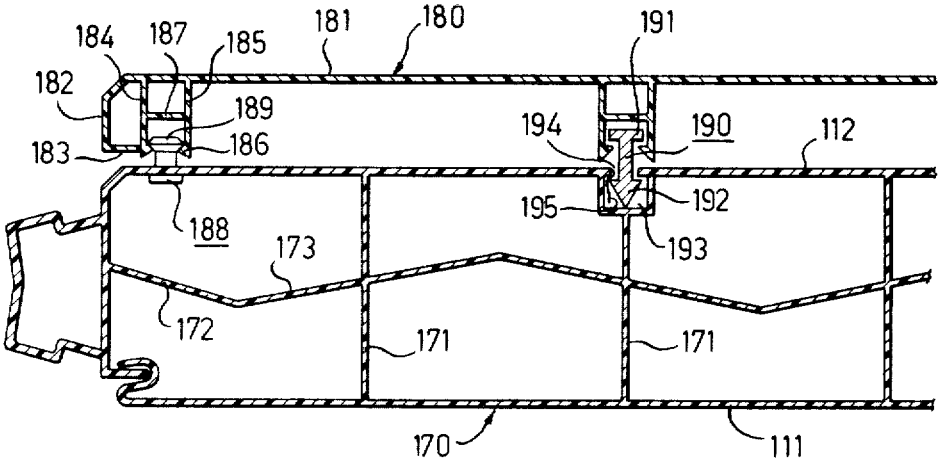
FIG. 6 shows a section through a building panel according to the invention with an axuiliary building panel.

FIG. 6 shows a building panel 170, which with respect to the formation of the ends, is formed similarly to that shown in the FIGS. 1-5. From this the connection of a plurality of building plates 170 need not be further described. A characteristic of the building panel 170 however consists in that the individual transverse walls 171 which connect the longitudinal walls 111, 112 are connected with each other through intermediate walls, which are formed out of two sections 172 and 173 running an obtuse angle to each other. Thus the entire intermediate wall is longer than the distance of adjacent transverse walls 171, so that longitudinal variations of the intermediate walls have little influence on the transverse walls.

FIG. 6 further shows an auxiliary building panel 180, which typically is formed of a single longitudinal wall 181. The end wall sections 182 are connected on the ends and lie in the same plane as the end wall sections of building panel 170 as may be understood clearly from FIG. 6. For reasons of aesthetic finish a section 183 of end wall section 182 is inwardly formed parallel to longitudinal wall 181. Such a wall section 183 of an auxiliary building panel 180 can also thus serve to fasten the auxiliary building panel 180 on the outer side of longitudinal wall 112 through adhesive.

Alternatively, ribs 184 and 185 are formed on the inner side of longitudinal wall 181, which run perpendicular thereto and spacedly parallel to each other. They have, on the free ends, locking projections 186 turned toward each other. Ribs 184 and 185 are additionally connected with each other through a web 187. A fastening means 188, for example, a rivet is shown, which in a customary way is inserted in the longitudinal wall 112, for example, through boring a hole and subsequently setting the rivet. The outwardly extending head 189 of the fastening means engages behind the projections 186 and thereby anchors the auxiliary building panel 180 on the building panel 170. It will be understood that a plurality of rivets and a plurality of ribs 184 and 185 can be provided in order to attain the desired fastening.

Instead of a fastening means 186, a fastening means 190 can also be used, which has a head 191 extending from the outer side of the longitudinal wall 112 and has a point 192 on the opposite end. The anchoring of head 191 corresponds to the anchoring of head 189 of the fastening means 188. The point 192, which forms shoulders with the shaft of fastening means 190, engages in a canal 193, rectangular in cross-section, which is formed on the inside of longitudinal wall 112. Outwardly, the canal has a slit 194, which is narrower than canal 193 so that the shoulders of head 192 can lockingly engage behind the edges of slits 194. At the beginning, the building panel 170 is so formed that the slit 194 is closed by a film 195. Initially with the mounting of an auxiliary building panel 180 the film is pierced at a desired place by means of fastening means 190.

The fastening means 190 can also be formed as a fastening strip as shown in cross-section in FIG. 6.

Figure 7:
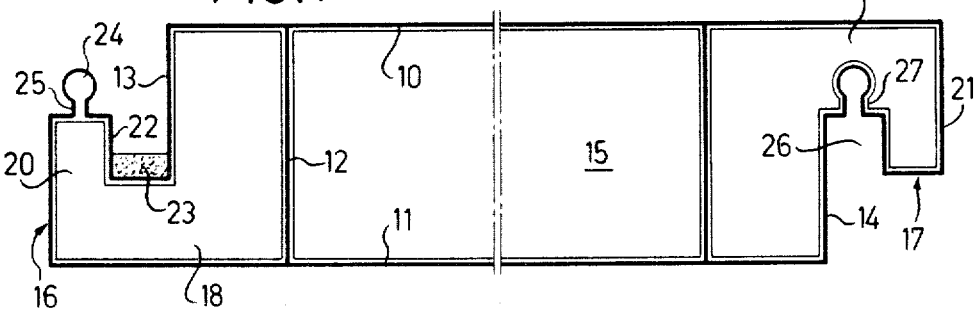
FIG. 7 shows an end view of a further embodiment of the building panel according to the invention.

The building panel of FIG. 7 represents an extruded box section of preferably light transmitting plastic (which is true for all other described embodiments) and has two side walls 10 and 11, connecting transverse wall 12 as well as parallel thereto end walls 13 and 14. The walls 10 through 14 form chambers 15 separated from each other, which provide for an advantageous thermal insulation.

On the end walls 13 and 14, angle sections 16 and 17 are formed with an associated elbow 18 and 19 and a free elbow 20 and 21. The free elbows 20 and 21 run parallel to end walls 13 and 14. Between the free elbow 20 and the end wall 13 a sealing groove 22 is formed which is U-formed in cross-section and in which a sealing material strip 23 of deformable sealing material is laid. The sealing material strip 23 is preferably self-adhesive.

On the free elbow 20, a locking profile flange 24, partially circular in cross-section, is formed, which is connected with free elbow 20 above a web 25, which is thinner than the diameter of the profile flange 24.

The disclosed building panels may be foamed inside with plastic material. All connecting transverse walls can then be omitted, so that the two separate side walls are connected with each other only through a foam material core. Additionally, the disclosed sections are formed on the exposed surfaces for the fastening and sealing in the disclosed manner.

The free elbow 21 of the angle section 17 forms a groove 26 with the end wall 14 for the mounting of the free elbow 20 as well as a locking groove 27 formed complementary to the flange 24 and to the web 25.

Preferably, several of the building panels shown in FIG. 7 can be arranged next to each other in a row, so that the free end of free elbow 21 meets in engagement with the sealing strip 23 with simultaneous locking of the locking flange 24 in the locking groove 27.

Figure 8:
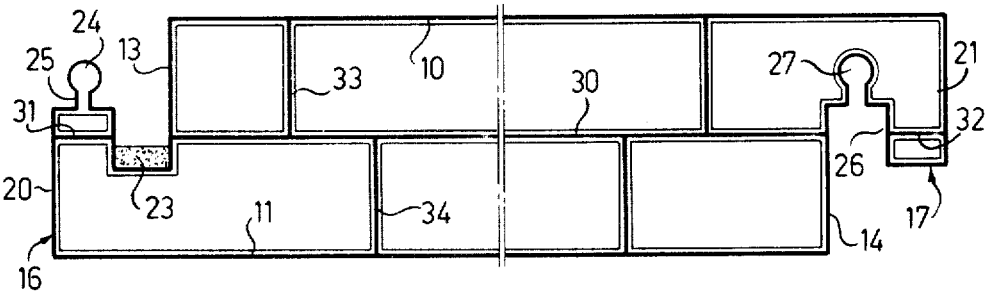
FIG. 8 shows an end view of a further embodiment of a building panel according to the invention.

The embodiment according to FIG. 8 is similar to that of FIG. 7, so that similar parts have similar reference numbers. The essential difference occurs in that an intermediate wall 30 is provided parallel to the side walls 10 and 11, which divides the entire building panel symmetrically in two halves. Also, the free elbows 21 and 20 are provided with the thereto aligned intermediate walls 31 and 32. With the same spacing of side walls 10 and 11, the building panel is considerably more stable with the addition of the intermediate wall 30. With the same stability it is possible to increase the spacings of side walls 10 and 11 and thereby to improve the thermal insulation properties. A further difference with respect to the embodiment of FIG. 7 lies in that the transverse walls 33 and 34 are arranged staggered with respect to each other on both sides of the intermediate wall.

Figure 9:
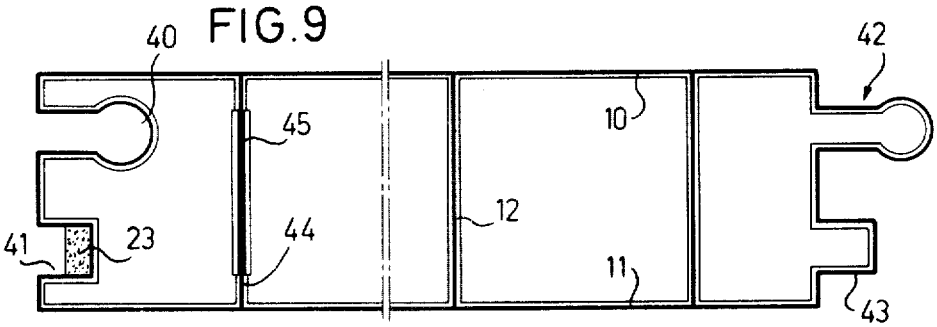
FIG. 9 shows a further embodiment of a building panel according to the invention.

The embodiment according to FIG. 9 possesses, on the other hand, side walls 10 and 11 and transverse wall 12. On the exposed end surface of the building panel according to FIG. 9, a locking groove 40 is provided on one side and next to it a sealing groove 41, while on the oppositely lying end surface a locking flange 42 and next to it a sealing flange 43 are provided. Locking groove 40 and sealing groove 41, on the one hand, and locking flange 42 as well as sealing flange 43, on the other hand, are formed complementary to each other, so that a preselected number of disclosed building panels can be arranged next to each other on a row and interlocked. However, mounting in the plane of the building panel must follow.

The sealing groove contains again a sealing strip.

As an alternative embodiment, a transverse wall 44 is so formed that it surrounds a stiffening element 45, which for example can be a steel or aluminum strip.

Figure 10:
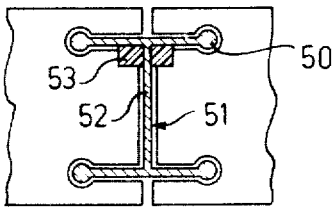
FIG. 10 shows an end view of a connection of two adjacent building panels.

With the embodiment according to FIG. 10, the exposed surfaces of the building panel are similarly formed and have two interlocking grooves 50 with parallel walls running perpendicular to the exposed surface and having a cylindrical bottom. The grooves accommodate the ends of a double T section 51, which ends are formed complementary to the grooves, in order to achieve a locking. Also, a seal 53 in the exposed surface is inserted on both sides of the flange 52 of the double T section 51, which meets in engagement with the flange 52.

Figure 11:
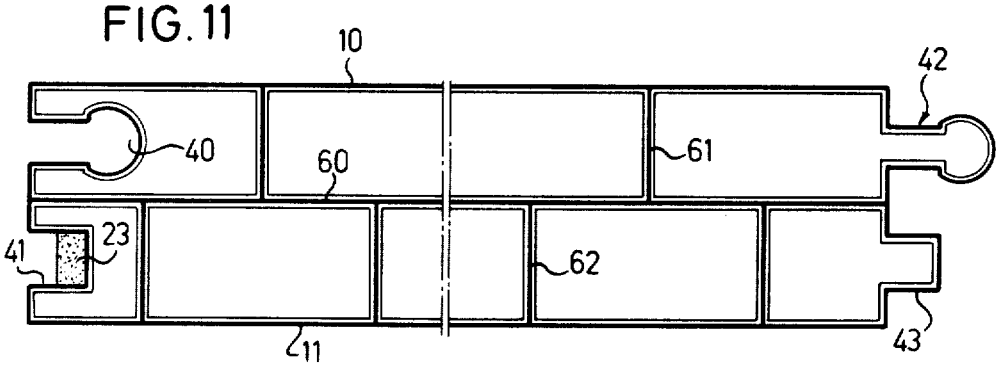
FIG. 11 shows an end view of a further embodiment of the building panel according to the invention.

The embodiment according to FIG. 11 differs from that according to FIG. 9 merely by the presence of an intermediate wall 60 formed longitudinally in the middle, for the purpose of forming a "double-chamber" building panel. Also, the intermediate walls 61 and 62 on both sides of the intermediate wall 60 are again arranged staggered to each other. The advantages of the refinement have already been discussed above in connection with the embodiment according to FIG. 8.

Figure 12:
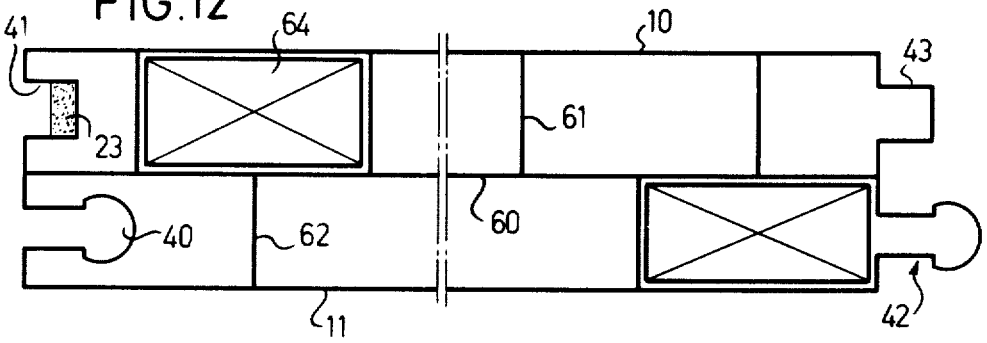
FIG. 12 shows an end view of a further embodiment of the building panel according to the invention.

The embodiment according to FIG. 12 corresponds to that of FIG. 11. In the chambers formed through the individual walls, box formed stiffening sections 64 are arranged.

Figure 13:
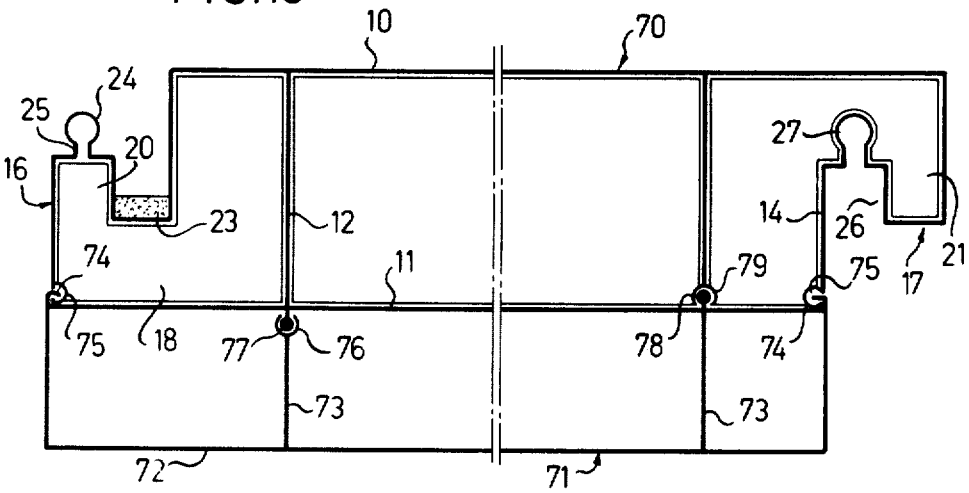
FIG. 13 shows an end view of a further embodiment of the building panel according to the invention.

The embodiment of FIG. 13 shows a main building panel 70 and auxiliary building panel 71. The main building panel 70 corresponds approximately to that of FIG. 7 and is thus provided with the similar reference numerals, which refer to similar parts. The auxiliary building panel 71 has a face wall 72 as well as transverse walls 73 so that on one side inwardly opening chambers are formed. The end transverse walls 73 are, as indicatedby 74, hook formed and bringable into engagment in an interlocking groove 75 in the end wall on the outer side of the free elbow 20. The heredescribed interlocking can however, also be formed in other known ways and means.

Another middle transverse wall 73 possesses on a free end an interlocking canal 76, in which a strip formed interlocking nub 77 may be brought in interlocking engagement. Nub 77 is formed in the transverse wall 12 in the area of the side wall 11 of the main building panel.

Alternatively to this, with another transverse wall 73 a ridge formed nub 78 is formed on the end which is in interlocking engagement with an interlocking groove 79 in the side wall in the area of transverse wall 12 of the main building panel 70.

It is understood that other locking means between the main and auxiliary building panels are also possible. Also however the auxiliary building panel 71 itself can be provided with interlocking means in order to accommodate further auxiliary panels.

It is understood that in each case a plurality of grooves having a sealing strip can be provided, while in the exemplary embodiment in each case only one is shown on the end wall. So can, for example, two or more grooves be provided. Equally, the number of interlocking profiles in the end walls is not limited to one per end wall. Somewhat as in the exemplary embodiment according to FIG. 9, both sides of a sealing groove or thereto complementary projection could be provided with an interlocking groove or an interlocking strip.

With reference to FIG. 10 it is also to be noted that instead of a double T section, a cross-like section or other profile form could be used, which lockingly engages in the end wall grooves and contributes to the sealing, if the corresponding sealant is provided in the end wall.

claim:

1. A box formed building panel formed of, preferably transparent, extruded plastic materials, said panel having opposing side walls and end walls normal thereto, said panel containing partition walls forming a plurality of internal hollow spaces; one of said end walls having a groove (114) extending along its entire length and running parallel to said side walls, the bottom of said groove being defined by a partition wall (113) adapted to support a resiliently deformable sealing material (149), the walls (115, 116) of said groove and their junction with said bottom partition wall being inwardly spaced from the side walls of the panel, said groove walls being outwardly diverging and including converging locking shoulders (131, 132); the other of said end walls having a projection (135), the cross-sectional configuration of which is generally complementary to the cross-sectional configuration of said groove (114), said projection having locking shoulders in the walls thereof lockingly engageable with the locking shoulders of the groove walls of an adjacent, similarly formed building panel for joining the panels together, said end walls having wall portions in the areas not occupied by said groove or projection abuttable when the projection of one panel is inserted in the groove of an adjacent panel.

2. The building panel according to claim 1 characterized in that the form of groove (114) and projection (135) are symmetrical to the longitudinal medial plane of the building panel (110).

3. A building panel according to claim 1 wherein the portions of said groove walls and projection walls before and after the locking shoulders are generally parallel.

4. A building panel according to claim 1 or 3 wherein the locking shoulders extend at substantially a right angle to the associated wall portions.

5. A building panel according to claim 1 characterized in that on the partition wall forming the groove base, two spaced from each other ribs (147, 148) are formed, between which the sealing material (149) is arrangeable.

6. A building panel according to claim 5 characterized in that the sealing material is a strip (149) of elastic deformable sealing material mounted on said partition wall.

7. A building panel according to claim 5 characterized in that the elastically deformable sealing material is plastically molded in the intermediate space between ribs (147, 148).

8. A building panel according to claim 1 characterized in that the end surface (138) of locking projection (135) is formed outwardly arched.

9. A building panel according to claim 1 characterized in that the partition wall (113) forming the bottom of the groove receives on the side lying opposite to the groove (114) a reinforcing section (152).

10. A building panel according to claim 9 characterized in that spaced from the partition wall (113), on the inner side of the longitudinal walls (111, 112), inwardly referenced ribs (150, 151) are formed as an abutment for a reinforcing section (152).

11. A building panel according to claim 1 characterized in that on one side of the joinder element, the end wall (140) is inverted in the inside of the building panel (110) to form a curved fastening groove (144).

12. A building panel according to claim 1 characterized in that the hollow space is foamed with a suitable plastic material.

13. A building panel according to claim 1 characterized in that at least between the longitudinal walls (111, 112) transverse walls (171) are arranged, said transverse walls being connected with each other by intermediate walls (172, 173) length of which is somewhat greater than the distance of adjacent transverse walls (171).

14. A building panel according to claim 1 characterized by an auxiliary building panel (180) with a single longitudinal wall (181), which on the sides has bent end surface forming sections (182) and on a side of the longitudinal wall has formed a pair of web arrangements (184, 185) which on the free sides have undercuts (186) for the purpose of anchoring of fastening means (188, 190).

15. A building panel according to claim 14 characterized in that on the inside of a longitudinal wall (112), canals (193) are formed, the side of which running in the longitudinal wall plane is closed with a film (195), whereby the canals (193) have undercuts to mount a fastening means (190).

16. A building panel according to claim 1 characterized in that one or more intermediate walls (30, 60) parallel to the side walls (10, 11) are provided.

17. The building panel according to claim 16 characterized in that the transverse walls (34, 62) on both sides of an intermediate wall (30, 60) are arranged staggered to each other.

18. A building panel according to claim 16 characterized in that in the individual chambers a stiffening section (64) is arranged in the form of strip formed stiffening element (45) in the walls (44).

* * * * *